US008662454B2

(12) United States Patent
Thiemann

(10) Patent No.: US 8,662,454 B2
(45) Date of Patent: Mar. 4, 2014

(54) METHOD FOR VISUALIZING TRACK OCCUPANCY

(75) Inventor: Joern Thiemann, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/822,457

(22) PCT Filed: Sep. 5, 2011

(86) PCT No.: PCT/EP2011/065250

§ 371 (c)(1), (2), (4) Date: Mar. 12, 2013

(87) PCT Pub. No.: WO2012/034878

PCT Pub. Date: Mar. 22, 2012

(65) Prior Publication Data

US 2013/0168504 A1 Jul. 4, 2013

(30) Foreign Application Priority Data

Sep. 14, 2010 (DE) ..... 10 2010 045 461

(51) Int. Cl.
*B61L 23/34* (2006.01)

(52) U.S. Cl.
USPC ..... 246/122 R; 701/19

(58) Field of Classification Search
USPC ..... 246/122 R, 123, 124; 701/19, 117, 301
See application file for complete search history.

(56) References Cited

U.S. PATENT DOCUMENTS

| | | | | |
|---|---|---|---|---|
| 3,895,584 | A * | 7/1975 | Paddison | 104/88.03 |
| 3,953,714 | A * | 4/1976 | Gabillard | 701/117 |
| 5,177,684 | A * | 1/1993 | Harker et al. | 701/117 |
| 5,623,413 | A * | 4/1997 | Matheson et al. | 701/117 |
| 6,169,495 | B1 * | 1/2001 | Koike | 701/302 |
| 6,947,815 | B2 * | 9/2005 | Young et al. | 701/19 |
| 7,539,624 | B2 * | 5/2009 | Matheson et al. | 705/7.22 |
| 7,558,740 | B2 * | 7/2009 | Matheson et al. | 705/7.26 |
| 7,725,249 | B2 * | 5/2010 | Kickbusch et al. | 701/117 |
| 8,082,071 | B2 * | 12/2011 | Daum et al. | 701/19 |
| 8,433,461 | B2 * | 4/2013 | Daum et al. | 701/19 |
| 8,457,892 | B2 * | 6/2013 | Aso et al. | 701/519 |

FOREIGN PATENT DOCUMENTS

| | | | |
|---|---|---|---|
| DE | 102006002607 | A1 | 7/2007 |
| EP | 0 911 778 | A2 | 4/1999 |
| WO | 2007082799 | A1 | 7/2007 |

OTHER PUBLICATIONS

Hille, P., "Das Graphiksystem GC10M in der rechnerunterstuetzen Zugueberwachung", Signal + Draht, Nov. 1, 1989, pp. 232-235, vol. 81, No. 11, Telzlaff Verlag GmbH, Darmstadt, Germany.

(Continued)

*Primary Examiner* — Jason C Smith
(74) *Attorney, Agent, or Firm* — Laurence A. Greenberg; Werner H. Stemer; Ralph E. Locher

(57) ABSTRACT

A method of visualizing a track occupation in a train movement tracking and/or planning system for railway safety equipment for at least one train on the basis of a time-distance line diagram (TDL diagram) which is produced as computer graphics. In order to enable potential train routing collisions that are due to delays to be detected, the distance is displayed graphically as a function of time and of a further coordinate, characterizing a delay time, in a three-dimensional coordinate system.

3 Claims, 2 Drawing Sheets

(56) References Cited

OTHER PUBLICATIONS

Grabs, U., "Konflikterkennung und-loesung fuer dispotitive Aufgaben in Betriebszentralen", Signal + Draht, Jul. 1, 1994, pp. 254-258, Vo. 87, No. 7/08, Telzlaff Verlag GmbH, Darmstadt, Germany.

Ushida, K. et al., "Increasing Rosustness of Dense Timetables by Visualization of Train Traffic Record Data and Monte Carlo Simulation", 9th Congress on Railway Research, May 22-26, 2011, pp. 1-12.

* cited by examiner

METHOD FOR VISUALIZING TRACK OCCUPANCY

BACKGROUND OF THE INVENTION

Field of the Invention

The invention relates to a method for visualizing track occupancy in a train movement tracking and/or train movement planning system in railroad protection technology for at least one train on the basis of a time-distance line diagram (TDL diagram) which is produced as computer graphics.

The current as well as the preplanned track occupancy must ensure that a minimum distance is observed between the trains, and that collisions are, as it were, excluded. One means of immediately detecting track occupancy conflicts is visual display by means of a time-distance line diagram, which is usually denoted as a TDL diagram. As illustrated in FIG. 1, an X-Y coordinate system is used for this purpose. The X-axis or the Y-axis serves to indicate the time coordinate, for example the hours and minutes of a day, while the other axis plots spatial data, for example kilometer marks or railroad station designations. A time-distance line is plotted in the coordinate system for each train. Consequently, it is possible to detect for each train movement at what time the train is planned to stop at a particular location. A line marks the current situation at the instant t. Train movement tracking systems in the form of TDL diagrams with desired and actual data for each train at the instant t enable the detection of delays and collision risk. In this case, however, the straightforwardness with which the graphics visualization, that is to say the user interface, can be viewed is, rather suboptimal.

BRIEF SUMMARY OF THE INVENTION

It is the object of the invention to specify a method for visualizing track occupancy in the case of a train movement tracking and/or train movement planning system in railroad protection technology for at least one train on the basis of a TDL diagram which is produced as computer graphics, which system enables a better detectability of a track occupancy conflict in conjunction with a delay situation.

According to the invention, the object is achieved by virtue of the fact that the distance is displayed graphically as a function of time and a further coordinate which characterizes a delay time in a three-dimensional coordinate system.

The use of three-dimensional time-distance "peaks" with the delay time as third dimension allows a display of the track occupancies that is more straightforward to view, both in the planning phase and in running operation. In the case of simulated or actual delay of a specified order of magnitude for at least one train, it is rendered possible to detect which train movements come into contact with one another, and thus will likewise lead to delays. Optimum countermeasures may be derived from this knowledge. In addition to a temporary increase in speed, sensible in terms of energy, of all delayed trains, another possible result may be to adjust the timetable so as to eliminate conflict nodes. It is also possible to fall back onto past experience in the case of similar delay peaks.

The result of including the delay times of all trains in the computer graphics as claimed is that it can be detected at first sight which trains must wait, for example because of collision risk or because of their connecting train characteristic, until the arrival of the originally delayed train, and how long the delay time currently is and will be in future. The simulation of various parameters, for example the speed of at least one delayed train, allows an optimum procedure to be derived by, as it were, gambling in relation to successively decreasing the delay of each individual train. In addition to punctuality, it is possible in this case also to take account of the energy consumption or the priority of a certain train type.

The result of the advantageous development as claimed, that is to say rotation of the coordinate system about a spatial axis, is to enable a visual impression of the extent to which delays are presently building up to be yet further enhanced. Consequently, even in the case of very complex railroad systems, for example in the railroad station area, it is possible to provide a high reliability in the planning of the track occupancy, as also in the case of train movement tracking for controlling the actual track occupancy state as a function of train delays, or vice versa.

The invention is explained in more detail below with the aid of illustrative figures, in which:

DESCRIPTION OF THE INVENTION

Figure 1:
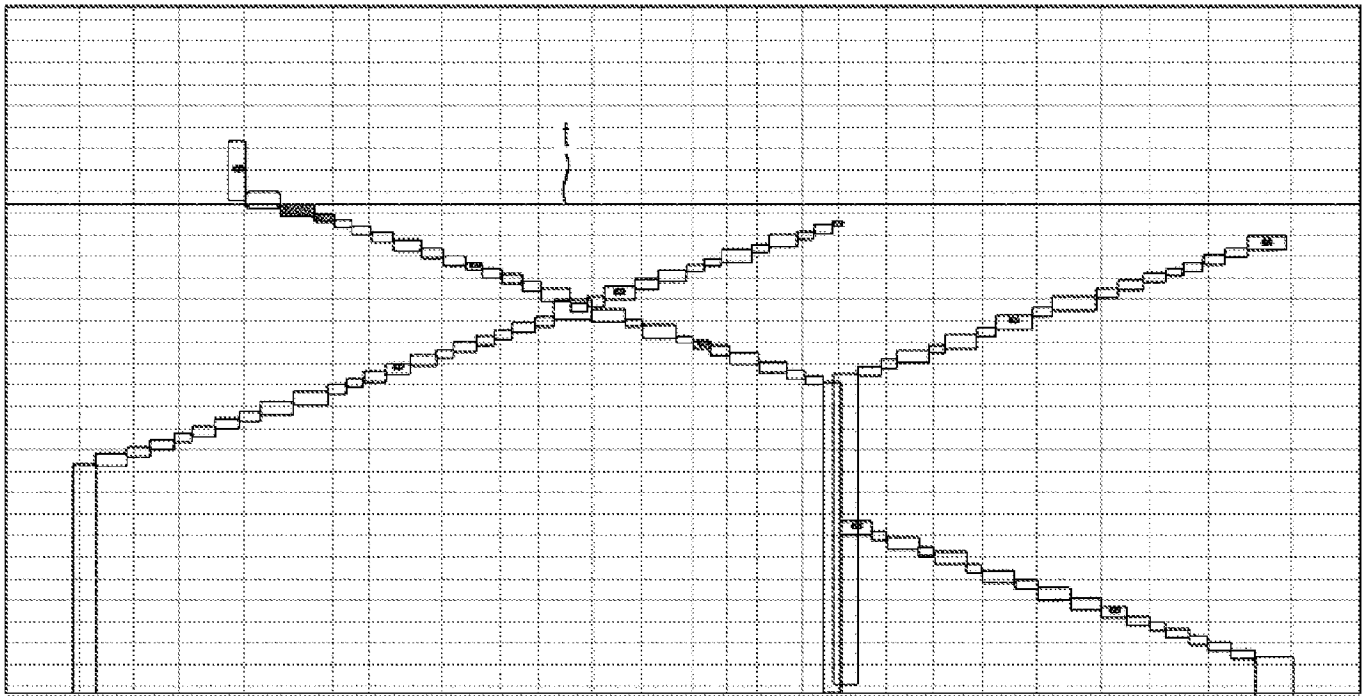
FIG. 1 PRIOR ART
FIG. 1 shows a diagram in accordance with the prior art.

FIG. 1 shows a TDL diagram (time/distance line diagram) in a type of display that is very common and explained above.

Figure 2:
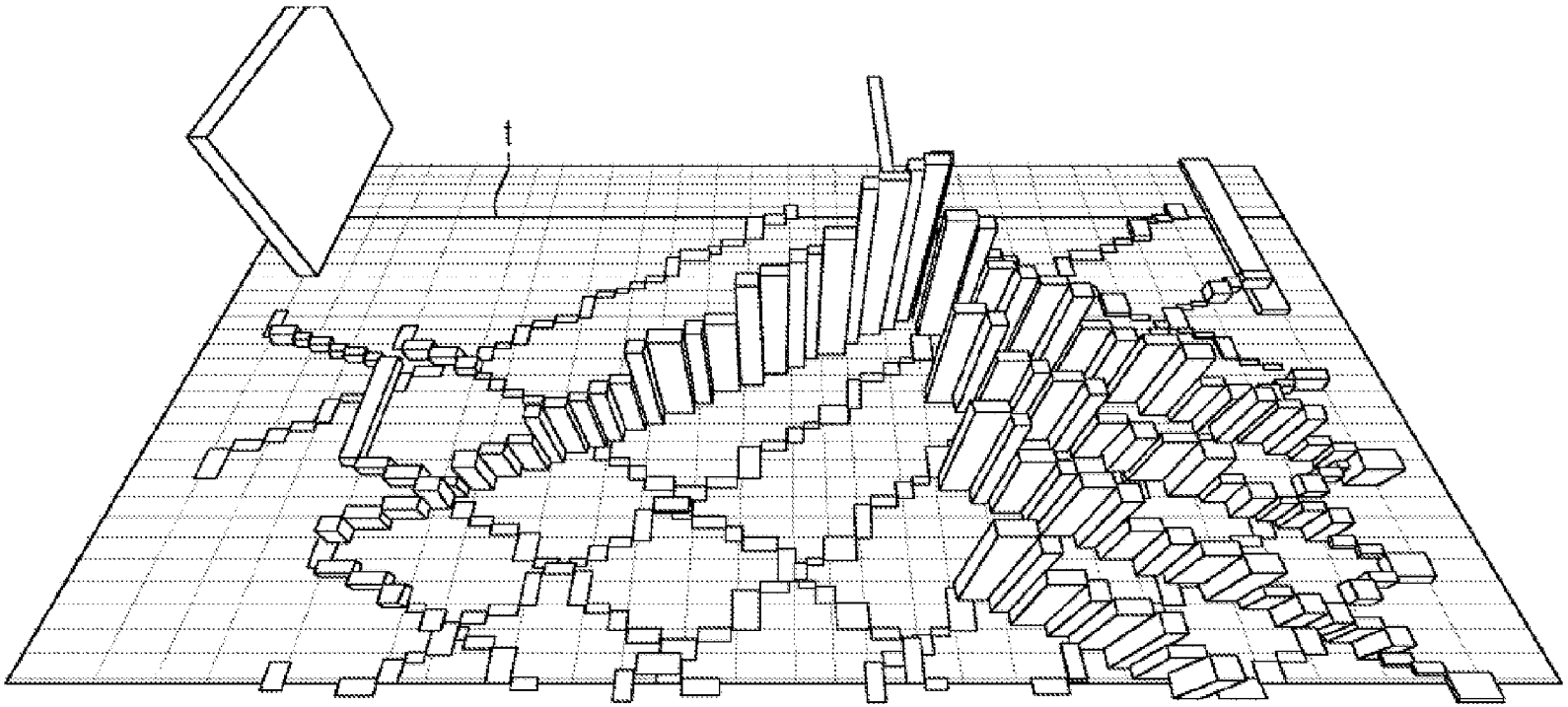
FIG. 2 shows an inventive diagrammatic display.

The inventive use of a delay time as third dimension is illustrated in FIG. 2. This combination renders it possible to detect at which instance a particular trackbound vehicle will experience a particular delay. Such a quantitative statement relating to the delay is impossible using the known TDL diagram in accordance with FIG. 1. The 3D display is possible in real time both for train movement planning and for train movement tracking. The higher the bar, the longer is the delay time. It may be detected at once in the 3D diagram that it is possible that delays may suddenly occur in future which can only be decreased slowly in further course. Suitable software components can be used to continuously recalculate the parameters during the real operation. A disposition component of a transport operator calculates the delay for the railbound vehicle using an actual/desired comparison with reference to the timetable. It may thereby be detected in advance how delays act in the system as a whole. Suitable measures to minimize the delays can be initiated early and optimized.

The invention claimed is:

1. In a train movement tracking and/or train movement planning system of a railroad protection technology system, a method of visualizing track occupancy for plurality of trains, which comprises:

producing a time-distance line diagram (TDL diagram) computer graphics for visualizing track occupancy for the plurality of trains;

displaying distance graphically as a function of time and a further coordinate characterizing a delay time in a three-dimensional coordinate system;

graphically displaying in the three-dimensional coordinate system a predicted development of delay times of all trains in the train movement tracking and/or train movement planning system; and enabling the coordinate system to be rotated about at least one spatial axis.

2. The method according to claim 1, which comprises, if the TDL diagram indicates delay times for one or more trains, taking countermeasures to minimize or eliminate the delay times.

3. The method according to claim 2, wherein the countermeasures include increasing a speed of one or more trains or adjusting a time table.

* * * * *